US007036494B1

(12) United States Patent
Hsieh

(10) Patent No.: US 7,036,494 B1
(45) Date of Patent: May 2, 2006

(54) IGNITION ENHANCEMENT DEVICE FOR ENHANCING IGNITION EFFICIENCY OF CAR ENGINE

(75) Inventor: Chih-Yu Hsieh, P.O. Box 90, Tainan City 70499 (TW)

(73) Assignees: Chih-Yu Hsieh, Tainan Hsien (TW); Chun-Yu Kuo, Tainan (TW); Kuan-Chen Liu, Tainan Hsien (TW)

( * ) Notice: Subject to any disclaimer, the term of this patent is extended or adjusted under 35 U.S.C. 154(b) by 0 days.

(21) Appl. No.: 11/255,037

(22) Filed: Oct. 21, 2005

(51) Int. Cl.
*F02P 3/06* (2006.01)

(52) U.S. Cl. ..... 123/620; 123/627; 123/169 MG

(58) Field of Classification Search ..... 123/620, 123/627, 169 PA, 169 MG
See application file for complete search history.

(56) References Cited

U.S. PATENT DOCUMENTS 1,406,858 A * 2/1922 Henricks ..... 123/620
1,413,140 A * 4/1922 Sutherlin ..... 123/169 G
2,684,451 A * 7/1954 Castongay ..... 313/146
2,965,779 A * 12/1960 Zalesak ..... 313/51
3,939,814 A * 2/1976 Bergstresser ..... 126/620
4,351,308 A * 9/1982 Halilovic et al. ..... 123/620
4,549,114 A * 10/1985 Herden ..... 123/169 MG
4,636,690 A * 1/1987 Herden et al. ..... 123/169 MG
4,774,914 A * 10/1988 Ward ..... 123/169 MG
4,944,280 A * 7/1990 Washington ..... 123/627
6,089,214 A * 7/2000 Anderson ..... 123/620
6,899,092 B1 * 5/2005 Arens ..... 123/620
2004/0194768 A1 * 10/2004 Kiker ..... 123/620

* cited by examiner

*Primary Examiner*—Erick Solis

(57) ABSTRACT

An ignition enhancement device for enhancing ignition efficiency of car engine is installed between a high voltage wire and a spark plug. The ignition enhancement device has a capacitor. Two sides of the capacitor are connected to two metal conductive rods. An insulating sleeve encloses the capacitor; and two sides of the insulating sleeve are formed with two insertion holes. An outer wall of each of the two sides of the insulting sleeve has an annular slot; and two ends of the capacitor being covered by waterproof rubbers. When the engine is actuated, the capacitor serves to store the current from the high voltage wire. When the capacitor saturates, electrons are charged to the spark plug simultaneously so as to enlarge the current to have the effect of enhancing the discharge of the current. Thus, the ignition can be enhanced and the fuel is burnt completely.

3 Claims, 3 Drawing Sheets

IGNITION ENHANCEMENT DEVICE FOR ENHANCING IGNITION EFFICIENCY OF CAR ENGINE

FIELD OF THE INVENTION

The present invention relates to vehicle ignition, and particularly to an ignition enhancement device for enhancing ignition efficiency of car engine, wherein the capacitor of the present invention has the effect of storing current and the electric power is discharged simultaneously so as to enhance the function of ignition. In the present invention, the ignition effect of the spark plug is enhanced so that fuel is combusted completely. Thus, the output power of the vehicle is enhanced and the exhaustion of waste gas is reduced.

BACKGROUND OF THE INVENTION

Generally, when actuating a vehicle, high voltage current from high voltage coils is supplied to a spark plug for ignition so as to actuate an engine. Since the high voltage current from the high voltage coils is not completely applied to the spark plug, the ignition is not effective. Moreover, carbon debris will accumulate in the spark plug. As a result, lifetime of the electric or electronic device is shortened. Furthermore, a great amount of waste gas due to incomplete combustion will pollute environment.

SUMMARY OF THE INVENTION

Accordingly, the primary object of the present invention is to provide an ignition enhancement device for enhancing ignition efficiency of car engine, wherein the capacitor of the present invention has the effect of storing current and the electric power is discharged simultaneously so as to enhance the function of ignition. In the present invention, the ignition effect of the spark plug is enhanced so that fuel is combusted completely. Thus, the output power of the vehicle is enhanced and the exhaustion of waste gas is reduced.

To achieve above objects, the present invention provides an ignition enhancement device for enhancing ignition efficiency of car engine which is installed between a high voltage wire and a spark plug. The ignition enhancement device has a capacitor. Two sides of the capacitor being is connected to two metal conductive rods. An insulating sleeve encloses the capacitor; and two sides of the insulating sleeve are formed with two insertion holes. An outer wall of each of the two sides of the insulting sleeve has an annular slot; and two ends of the capacitor being covered by waterproof rubbers. When the engine is actuated, the capacitor serves to store the current from the high voltage wire. When the capacitor saturates, electrons are charged to the spark plug simultaneously so as to enlarge the current to have the effect of enhancing the discharge of the current. Thus, the ignition can be enhanced and the fuel is burnt completely.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
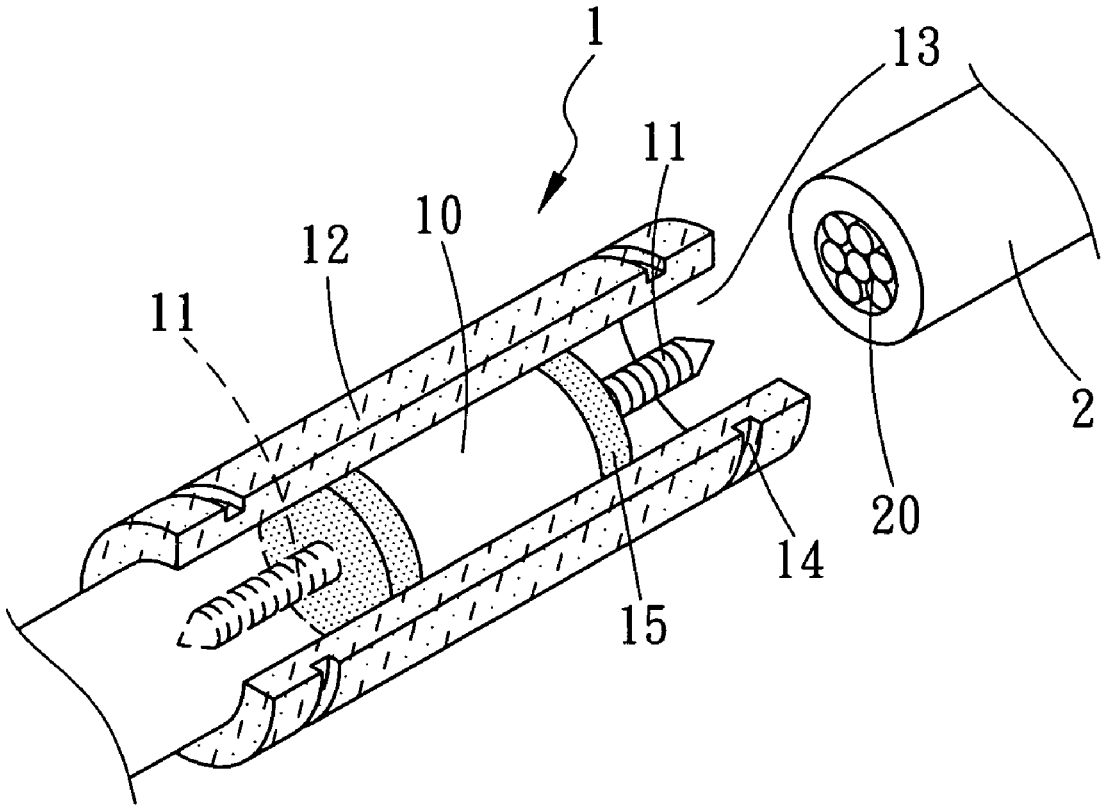
FIG. 1 is a structural view of the present invention.
Figure 2:
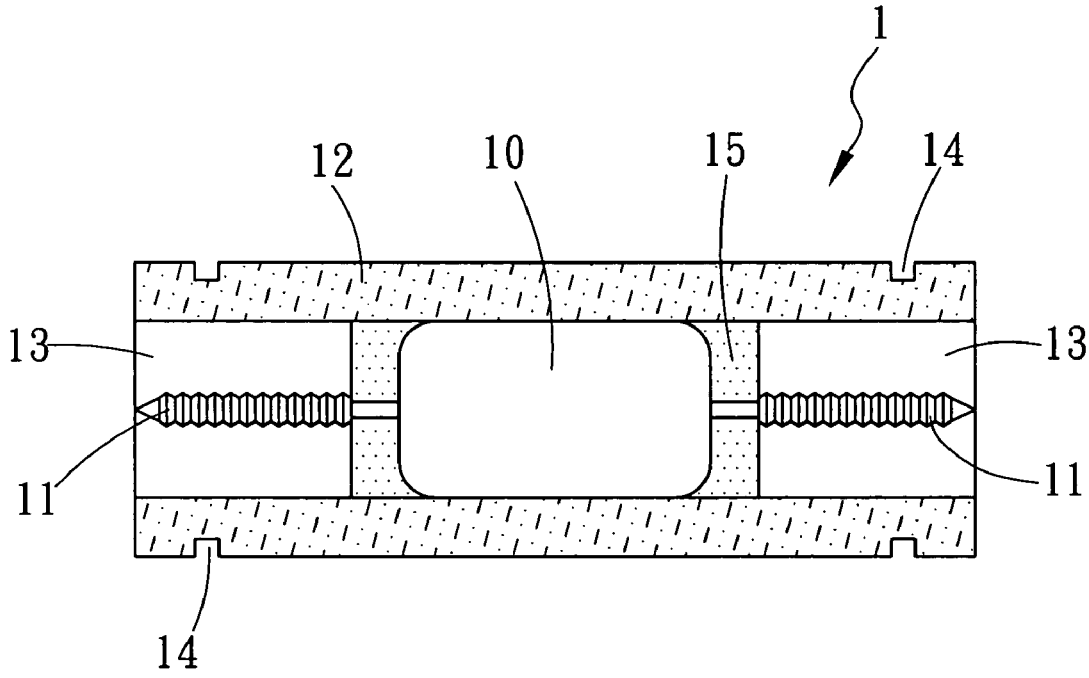
FIG. 2 is a schematic cross view of the present invention.
Figure 3:
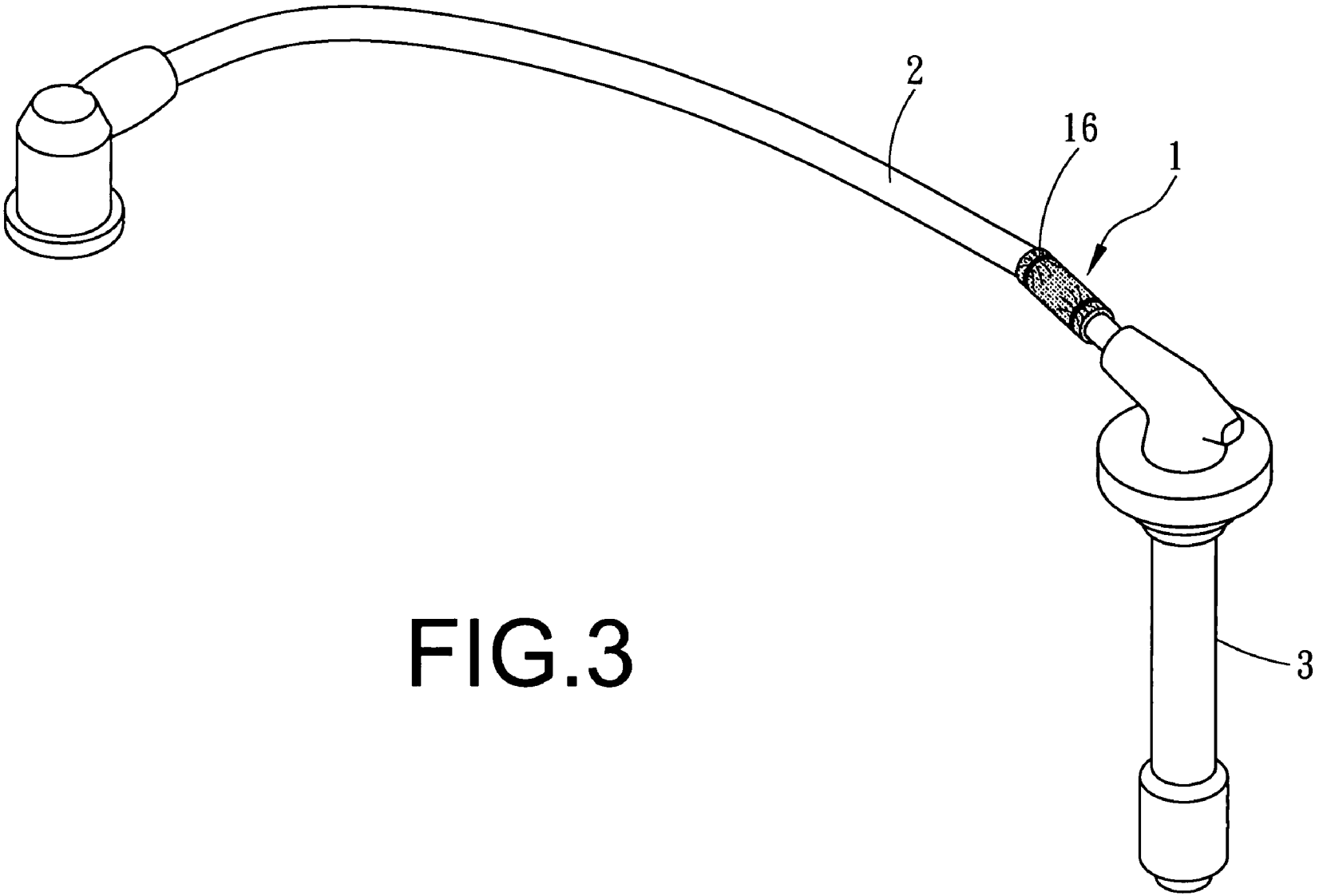
FIG. 3 is a perspective view of the present invention.

Referring to FIGS. 1 to 3, an ignition enhancement device 1 of the present invention is installed between a high voltage wire 2 and a spark plug 3. The ignition enhancement device 1 has a capacitor 10. Two sides of the capacitor 10 are connected to two metal threaded conductive rods 11. A silicon insulating sleeve 12 encloses the capacitor 10. Two sides of the insulating sleeve 12 are formed with two insertion holes 13. An outer wall of each of the two sides of the insulting sleeve 12 has an annular slot 14. Two ends of the capacitor 10 are covered by waterproof rubbers 15.

In assembly, the ignition enhancement device 1 is installed the high voltage wire 2 and the spark plug 3. That is, the high voltage wire 2 is cut into two sections which are connected to the two sides of the capacitor 10. The conductive rods 11 are screwed into the wire cores 20 of the high voltage wire 2. Retainers 16 serve to enclose the annular slots 14 so as to tightly engage the ignition enhancement device 1 and the high voltage wire 2.

Thereby when the engine is actuated, the capacitor 10' serves to store the current from the high voltage wire 2. When the capacitor 10 saturates, electrons are charged to the spark plug 3 simultaneously so as to enlarge the current to have the effect of enhancing the discharge of the current. Thus, the ignition can be enhanced and the fuel is burnt completely. Power of vehicle is increased and the exhaustion of waste power is reduced.

Advantages of the present invention will be described herein. In the present invention, when car drives, the capacitor of the present invention has the effect of storing current and the electric power is discharged simultaneously so as to enhance the function of ignition. In the present invention, the ignition effect of the spark plug is enhanced so that fuel is combusted completely. Thus, the output power of the vehicle is enhanced and the exhaustion of waste gas is reduced. Thereby air pollution is avoided. The present invention is installed at a distal end of an electric device so as to reduce the interference of the feedback signal to electric or electronic system. Furthermore, the insulating sleeve is used to enclose the capacitor. The connection between the capacitor and the high voltage wire is enhanced and the assembly is easy.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An ignition enhancement device for enhancing ignition efficiency of car engine; the ignition enhancement device being installed between a high voltage wire and a spark plug; the ignition enhancement device having a capacitor; two sides of the capacitor being connected to two metal conductive rods; an insulating sleeve enclosing the capacitor; two sides of the insulating sleeve being formed with two inser tion holes; an outer wall of each of the two sides of the insulting sleeve having an annular slot; and two ends of the capacitor being covered by waterproof rubbers;

wherein when the engine is actuated, the capacitor serves to store the current from the high voltage wire; when the capacitor saturates, electrons are charged to the spark plug simultaneously so as to enlarge the current to have the effect of enhancing the discharge of the current; thus, the ignition can be enhanced and the fuel is burnt completely; power of vehicle is increased and the exhaustion of waste power is reduced.

2. The ignition enhancement device for enhancing ignition efficiency of car engine as claimed in claim 1, wherein the conductive rods are threaded.

3. The ignition enhancement device for enhancing ignition efficiency of car engine as claimed in claim 1, wherein the insulating sleeve is made of silicon material.

* * * * *